United States Patent [19]

LeBaron

[11] Patent Number: 4,690,584

[45] Date of Patent: Sep. 1, 1987

[54] APPARATUS FOR SECURING ADJUSTABLE SUPPORT STRUCTURES FOR MANHOLE COVERS, GRATES AND THE LIKE

[75] Inventor: Francis LeBaron, East Bridgewater, Mass.

[73] Assignee: E. L. LeBaron Foundry Co., Brockton, Mass.

[21] Appl. No.: 724,082

[22] Filed: Apr. 17, 1985

[51] Int. Cl.[4] ..... E02D 29/14

[52] U.S. Cl. ..... 404/26

[58] Field of Search ..... 404/26, 25; 52/19–21

[56] References Cited

U.S. PATENT DOCUMENTS

| | | | |
|---|---|---|---|
| 638,692 | 12/1899 | Banwell | 404/26 |
| 2,930,295 | 3/1960 | Hale | 404/26 |
| 3,240,133 | 3/1966 | Ross | 404/26 |
| 3,331,295 | 7/1967 | Sorrell | 404/26 |
| 3,629,981 | 12/1971 | McCaffery | 52/19 |
| 3,858,998 | 1/1975 | Larsson et al. | 404/26 |
| 3,891,337 | 6/1975 | McCoy | 404/26 |
| 3,926,533 | 12/1975 | Binette | 404/26 |
| 3,930,739 | 1/1976 | Larsson et al. | 404/26 |
| 4,075,796 | 2/1978 | Cuozzo | 52/20 |
| 4,174,183 | 11/1979 | Ferns | 404/26 |
| 4,337,005 | 6/1982 | LeBaron | 404/26 |

FOREIGN PATENT DOCUMENTS

| | | | |
|---|---|---|---|
| 2260383 | 6/1974 | Fed. Rep. of Germany | 404/26 |
| 2356484 | 5/1975 | Fed. Rep. of Germany | 404/26 |

OTHER PUBLICATIONS

"Quik-Rise System" publication, Quality Water Products, Inc., South Barre, Mass., 1980.

*Primary Examiner*—Stephen J. Novosad
*Assistant Examiner*—John F. Letchford
*Attorney, Agent, or Firm*—Rines and Rines Shapiro and Shapiro

[57] ABSTRACT

An adjustable leveling apparatus for manhole covers, grates and the like within ground and similar structures, employing an annular extension ring received within an annular base ring having an internal ring seat, the extension ring being provided with inwardly disposed rigid bar members deformable over the ring seat to securely lock the extension ring within the base ring.

4 Claims, 5 Drawing Figures

Figure 1:
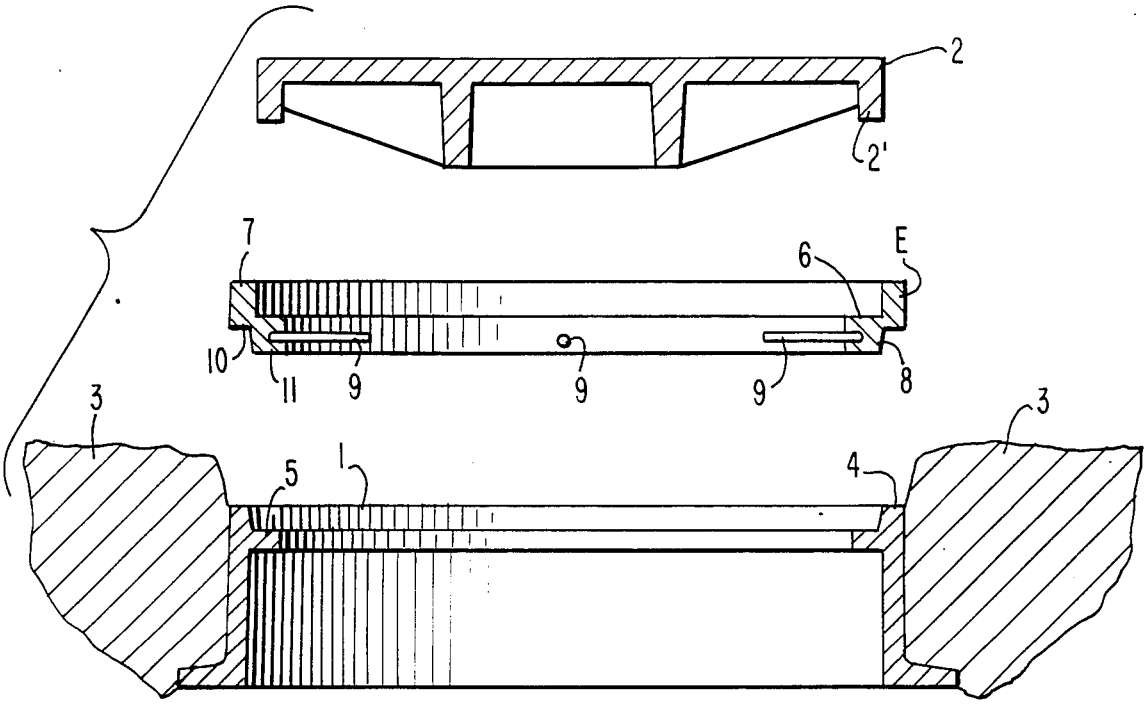

APPARATUS FOR SECURING ADJUSTABLE SUPPORT STRUCTURES FOR MANHOLE COVERS, GRATES AND THE LIKE

The present invention relates to support structures for road bed manhole covers, grates and the like, being more particularly directed to an apparatus for securing an extension ring adjustable support structure from unintentional removal or misalignment during use.

This art is replete with a wide variety of structures proposed and used through many years to try to provide a facile construction and method for adjustably leveling manhole covers and the like. As examples, concentric rotational adjustment structures date back before the turn of the century, at least to U.S. Pat. No. 638,692, with recent threaded versions appearing in U.S. Pat. Nos. 3,629,981 and 4,075,796. Bolts and similar mechanisms for adjusting the support level are illustrated in U.S. Pat. Nos. 2,930,295 and 3,858,998. Other methods have been proposed such as the "Quick-Rise System" described in a publication of that title published in 1980 by Quality Water Products, Inc., South Barre, Mass.

One of the most common methods for adjustably leveling manhole covers, however, is the use of extension rings as shown in U.S. Pat. Nos. 3,240,133; 3,331,295; 3,926,533; 4,337,005 and 4,174,183. In such a method, the manhole cover is removed and one or more extension rings are concentrically placed on the cover base, increasing the effective height of the cover supporting base. The cover is then placed on or partially within an uppermost extension ring.

These prior methods are replete with problems, however, including undesirable sliding and shifting of the extension rings and the inadvertent lifting of the extension ring, or a portion of the ring, away from the cover base. Such movement is generally caused by thermal expansion of the ground or other supporting structure, prying or striking as from a plow scraping the surrounding supporting structure, or other unintentional acts during use.

It is to the improved solution of these problems that the present invention is accordingly directed; it being an object of the invention to provide a novel apparatus for providing adjustable leveling of manhole covers, grates and the like, that shall not be subject to the above-described disadvantages and others of the prior art, and that shall resist undesirable lateral and horizontal shifting during use.

The present invention provides an extension ring that may be inserted into a base ring and securely attached to the base ring by one or more rigid, inwardly mounted bar members that are deformed to securely lock with or clinch the base ring.

A further object is to provide a new and improved apparatus for securely locking or clinching an extension ring to a base ring or cover base or the like.

Other and further objects and advantages will be explained hereinafter and are more particularly delineated in the appended claims.

In summary, from one of its novel aspects, the invention contemplates an apparatus for providing adjustable leveling of manhole covers, grates, and the like within ground and similar structures, having, in combination, an annular base ring provided with an internal ring seat and adapted to be secured within the ground or similar structure; an annular extension ring for supporting a cover, grate and the like at its upper edge and provided with a depending lower edge for engaging the said ring seat within the base ring; and the extension ring being provided with means disposed inwardly of the extension ring near its lower edge and being deformable to clinch over the ring seat of said base ring securely to lock the extension ring to the base ring. Preferred details and best mode embodiments are hereinafter presented.

Figure 2:
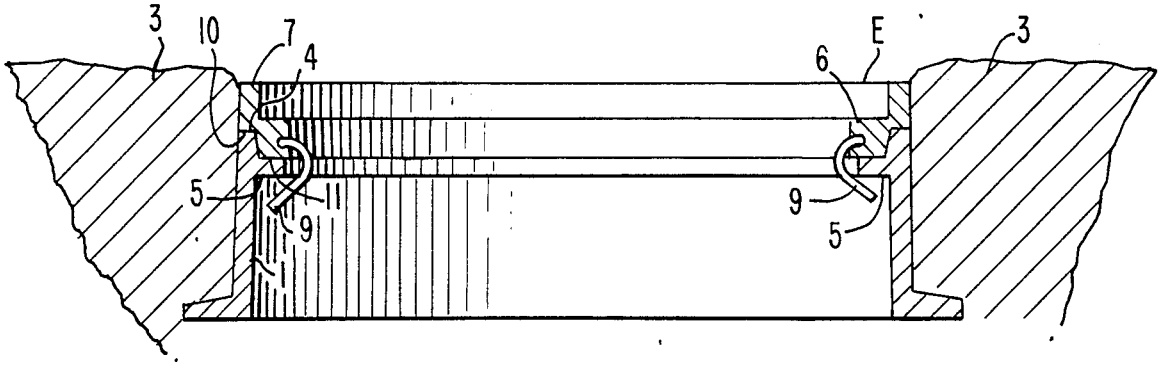
Figure 3:
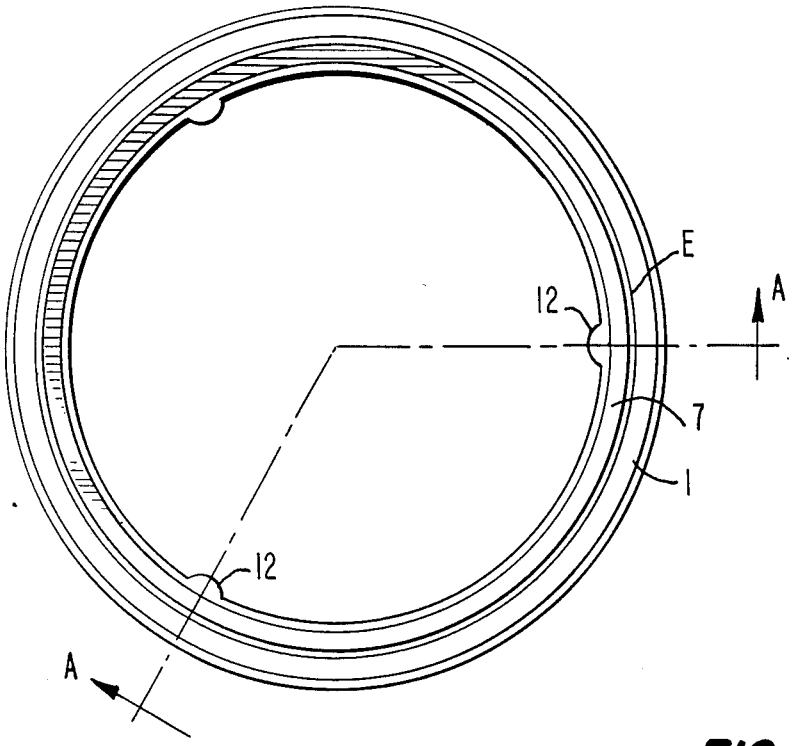
Figure 5:
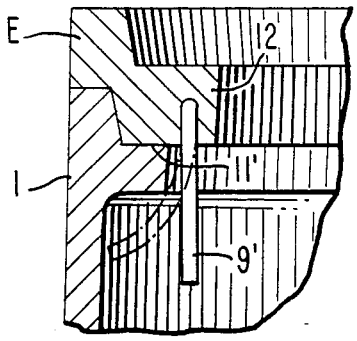
Figure 4:
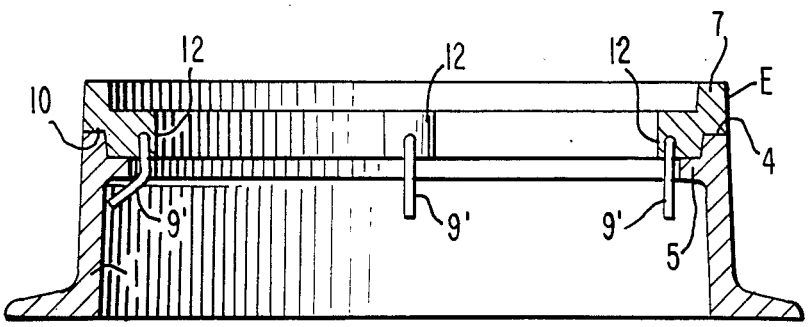

The invention will now be described with reference to the accompanying drawings, FIG. 1 of which is a transverse exploded sectional view of a base ring secured in the ground, shown unassembled from a manhole cover and an extension ring of the present invention; and FIG. 2 is a transverse sectional view ring and extension ring of FIG. 1, locked together and ready to receive the manhole cover;

FIG. 3 is a plan of a modified assembled base and extension ring structure; and FIG. 4 is a section taken along the line A—A of FIG. 3 upon an enlarged scale, with FIG. 5 being a fragmentary portion of FIG. 4 upon still a larger scale showing clinching over the base ring seat.

In FIG. 1, an extension ring E of the present invention is shown above a standard base ring 1 for supporting a manhole cover 2, or the like, secured in the ground 3 or similar support structure. The ground 3 may be composed of soil, rocks, pavement, brick, concrete or other similar materials. The base ring 1 is generally in the form of an annular ring or frame, shown circularly cylindrical, though other annular polygonic shapes including square or rectangular may be employed, requiring the use of similarly shaped extension rings E. The base ring 1, commonly referred to in the art as a manhole frame cover support structure, has an upper edge or rim 4 which is generally about flush with the surface of the ground 3 and receives the manhole cover 2. To support the manhole cover 2 flush with the upper edge 4 of the base ring 1, the base ring 1 is provided with an internal flange or seat 5 for engaging the depending edge or rim 2' of the cover 2.

To raise the effective height of the manhole cover 2, as when the ground 3 is built up to a level higher than the cover, as shown in FIGS. 1 and 2, the extension ring E may be used. The extension ring E of the invention is generally in the form of an annular ring and has an internal flange or seat 6 for supporting the depending edge 2' of the manhole cover 2, with the upper surface of the cover flush with the outer edge 7 of the extension ring E. The extension ring E is also provided with a lower section 8 of smaller diameter and shape equivalent to the manhole cover 2 to allow the lower rim 11 of the extension ring E to fit securely against the flange or seat 5 when inserted within the base ring 1, as shown in FIG. 2, with the step 10 between the outer and smaller diameter sections of the ring E engaging the outer rim 4 of the base ring 1. The combined height of the assembled base ring 1 and extension ring E is sufficient to support the manhole cover 2 flush with the surface of the ground 3.

To more securely hold the extension ring E within the base ring 1, the extension ring E is provided with one or more rigid bar members, such as concrete reinforcing steel bars 9, sometimes called "re-bars", secured at one end to the extension ring E near its lower edge and shown extending radially inwardly. Such bars 9 are especially adapted to this purpose as they are easily bendable but resist restoration forces back toward straight configuration. Additionally, the bars 9 can be easily secured to the extension ring E, as by being cast directly into the extension ring E during ring construction. The term "bar" is used generally to embrace rods, lugs, clips and similar suitable projections which are mounted inwardly of the ring.

After the extension ring E is inserted into the base ring 1, as discussed above, the re-bars 9 are bent over the flange or seat 5 or other suitable inner wall surface irregularity, as shown in FIG. 2, to lock the extension ring E in place within the base ring 1. For this purpose, the length of the rods is adjusted just to permit clipping over the flange or other projection or irregularity provided at or by the ring seat 5, including apertures or recesses, if desired. In the form shown, the free ends of the bent bars contact the flange substantially only at the junction of its undersurface and inner periphery, forming an acute angle with the undersurface, as can be seen in FIG. 2 and similarly in the embodiments of FIGS. 4 and 5 to be discussed later. Prying or striking of the extension ring E which would tend to pull up a section of the extension ring E near the bar 9, will be countered by the rigid securing nature of the same.

Preferably a plurality of bars 9 may be used, being positioned uniformly about the inside of the extension ring E to provide even securing to the base ring 1. By using such an extension ring E, a secured manhole support structure is created that provides an extended support base ring; and additional similar extension rings E can also be secured to successively lower extension rings by appropriate ring seat locking apertures, recesses or lugs, as desired.

Further modifications including, for example, internal extension ring spaced bosses 12 with depending or vertical clinching bars 9', FIGS. 3–5, and other clinching structures will also occur to those skilled in this art and such are considered to fall within the spirit and scope of the invention as defined in the appended claims.

What is claimed is:

1. Apparatus for providing adjustable leveling of manhole covers, grates, and the like within ground and similar structures, having, in combination, an annular base ring provided with an internal ring seat and adapted to be secured within the ground or similar structure; an annular extension ring for supporting a cover, grate and the like at its upper edge and provided with a depending lower edge for engaging the said ring seat within the base ring; and the extension ring being provided with deformable bar means disposed inwardly of the extension ring near its said lower edge, said bar means extending lengthwise thereof substantially radially inwardly from an inner peripheral surface of the extension ring and being disposed such that said bar means may be bent over the ring seat of the said base ring securely to clinch the extension ring to the base ring.

2. Apparatus as claimed in claim 1 and in which the bar means includes a section of concrete-reinforcing steel bar.

3. Apparatus as claimed in claim 1 in which the bar means comprises a plurality of rigid bar members secured uniformly about the inside of the extension ring to provide even securing to the base ring.

4. Apparatus as claimed in claim 3 and in which said bar members are cast into the extension ring.

* * * * *